US005103583A

United States Patent [19]

VanErmen

[11] Patent Number: 5,103,583

[45] Date of Patent: Apr. 14, 1992

[54] PROTECTED PRINT LABEL

[75] Inventor: Paul VanErmen, Sioux Falls, S. Dak.

[73] Assignee: CCL Product Identification, Inc., Grand Rapids, Mich.

[21] Appl. No.: 547,231

[22] Filed: Jul. 2, 1990

[51] Int. Cl.[5] ..... G09F 3/10

[52] U.S. Cl. ..... 40/638; 40/299; 283/81

[58] Field of Search ..... 40/299, 638; 283/81

[56] References Cited

U.S. PATENT DOCUMENTS

| | | | |
|---|---|---|---|
| 714,485 | 11/1902 | Howard . | |
| 2,439,082 | 4/1948 | Emmey et al. | 40/299 |
| 2,671,678 | 3/1954 | Walsh | 40/299 X |
| 3,159,930 | 12/1964 | Allen et al. | 40/299 |
| 3,494,056 | 2/1970 | Elzer | 40/299 |
| 3,854,229 | 12/1974 | Morgan . | |
| 3,864,855 | 2/1975 | Pekko et al. . | |
| 3,974,311 | 8/1976 | Cherrin | 40/638 X |
| 4,068,028 | 1/1978 | Samonides | 40/299 X |
| 4,204,706 | 5/1980 | Blum et al. . | |
| 4,328,057 | 5/1982 | Gutow . | |
| 4,479,319 | 10/1984 | Erlich . | |
| 4,526,405 | 7/1985 | Hattemer . | |
| 4,661,189 | 4/1987 | Voy et al. . | |
| 4,763,930 | 8/1988 | Matney . | |
| 4,863,195 | 9/1989 | Capozzola | 283/81 X |

*Primary Examiner*—Kenneth J. Dorner
*Assistant Examiner*—Milton Nelson, Jr.
*Attorney, Agent, or Firm*—Warner, Norcross & Judd

[57] ABSTRACT

A label system is disclosed wherein a release backing is provided with an opening coextensive with a central portion of the rear surface of a label temporarily and releasably adhered thereto. The central portion of the rear surface of the label is free of adhesive and suitable for printing. The label may be conveniently printed with variable indicia at the time and place of use of the label. When applied, the indicia will be disposed under the label and protected from damage.

7 Claims, 1 Drawing Sheet

PROTECTED PRINT LABEL

BACKGROUND OF THE INVENTION

1. Field of the Invention

The present invention relates to labels and, more particularly, to a protected print label system having a label on a release backing, the backing having an opening coextensive with a central portion of the rear surface of the label to enable printing through the opening onto the rear surface.

2. Description of the Related Art

It is well known to provide contact adhesive labels temporarily adhered to a backing sheet. The rear surface of the labels are coated with a pressure sensitive contact adhesive, enabling the label to be removed from the backing sheet and adhered to an article. Such labels are usually preprinted with indicia such as lettering or designs.

Often it is desired to mark articles with variable information. In this context, the terms "variable information" and "variable indicia" are intended to include any kinds of markings which would be more conveniently applied to a label at the time or place of use of the label rather than the time or place of its manufacture. Such variable information would include, for example, dates, serial numbers, or lot numbers. This kind of marking is conventionally accomplished by marking directly on the article or by printing on the face of a label and adhering the label to the article. In either case, the markings or printings will be exposed to the environment and subject to damage, marring, or even erasure.

It is further known to print the rear surface of a translucent label, then to subsequently coat the printed surface with an adhesive for adherence to a backing sheet. In this case, the step of printing is, in effect, part of the process for manufacturing the label. Therefore, this approach is not feasible for a labeler who possesses only printing equipment and wishes only to print on premanufactured adhesive labels.

Thus, there is a unmet need for an adhesive label suitable for printing with variable indicia, which is conveniently printed at the time and place of use of the label, which protects the indicia from damage, and which does not require the user to become involved in handling adhesives or in other label manufacturing steps.

SUMMARY OF THE INVENTION

The present invention satisfies the aforementioned need by providing a label system and a labeling method in which a premanufactured label is temporarily and releasably adhered to a release backing, the backing having an opening coextensive with a central portion of the rear surface of the label. The central portion of the label is translucent and its rear surface is free from adhesive so that information may be marked on the rear surface of the label while the label is still adhered to the backing. After marking, the label is removed from the backing and adhered to the desired article. In this manner, the markings are disposed between the article and the label and protected thereby from damage. The user need possess only marking implements.

In a preferred embodiment, the invention includes a release backing in the form of an endless paper web or strip having a series of spaced rectangular windows. The labels are temporarily adhered to the web, one label disposed over each opening. The labels are larger than the openings, thereby defining a central area or portion of the rear surface of each label substantially coextensive with an opening in the backing and a label border to which a layer of pressure sensitive adhesive is applied. The labels are suitable for marking by hand or by printing or stamping equipment.

According to certain features of the invention, the label border may be of a contrasting appearance, such as by means of coloring or opacity. The central portion of the label then resembles a window. Portions of the label may be preprinted with nonvariable indicia.

These and other objects, advantages, and features of the invention will be more fully understood and appreciated by reference to the description of the preferred embodiment and the drawings.

DESCRIPTION OF THE PREFERRED EMBODIMENT

Figure 1:
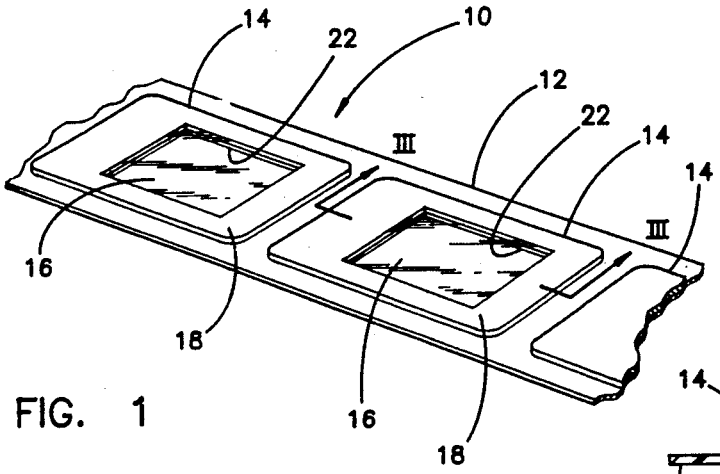
FIG. 1 is a fragmentary front perspective view of a label system according to the principles of the invention.
Figure 4:
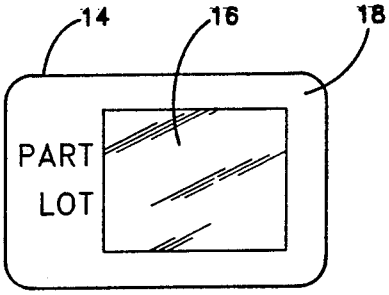
FIG. 4 is a front plan view of a label.
Figure 5:
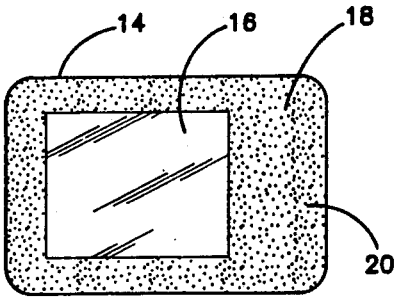
FIG. 5 is a rear plan view of the label of FIG. 4.

By way of disclosing a preferred embodiment of the invention, and not by way of limitation, there is shown in FIG. 1 a label system 10 which includes in its general organization a release backing 12 in the form of an elongated, continuous web and a plurality of labels 14 disposed at regular intervals along the length of the backing 12. Referring additionally to FIGS. 4 and 5, it may be seen that each label 14 is generally rectangular, having a central portion 16 surrounded by a peripheral border 18. The label central portion 16 is translucent to the extent that indicia marked or printed on the rear surface of the label will be legible from the front surface. Usually, the central portion 16 will be colorless and transparent. The label border 18 is colored and opaque to contrast with the central portion. However, the border 18 may also by translucent and otherwise undelineated from the central portion 16. The legends "PART" and "LOT" are preprinted on the label border 18.

As best shown in FIG. 5, pressure sensitive contact adhesive 20 is provided on the rear surface of the label 14. The adhesive 2 is disposed substantially only in the area defined by the label border 18, which may extend all or part of the way around the periphery of the label. As is well known in the art, the adhesive is of a type which adheres firmly to the label 16 but which cooperates with the release backing 12 to allow the label to be temporarily and releasably adhered to the backing. The rear surface of the label central portion 16 is free of adhesive, thereby providing a printable area. Although the central portion 16 is preferably adhesive-free to facilitate printing, labels including adhesive over their entire rear surface are included within the broadest scope of the concept.

Figure 3:
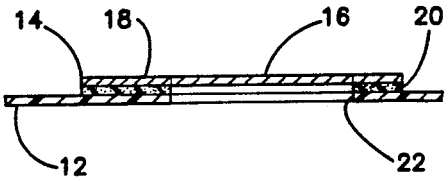
FIG. 3 is a sectional view taken along the line 3—3 of FIG. 1 with thickness exaggerated for clarity.
Figure 2:
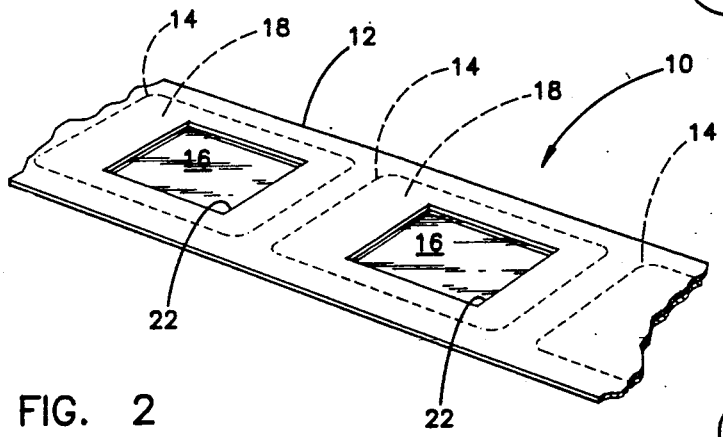
FIG. 2 is a fragmentary rear perspective view of the label system of FIG. 1.

As shown in FIGS. 1, 2, and 3, the release backing 14 is provided with a plurality of openings 22 disposed at spaced intervals corresponding to the spacing of the labels 14. Each opening 22 is substantially coextensive with the central portion of a label 14, thereby providing access to the rear central portion for marking or printing purposes.

Figure 6:
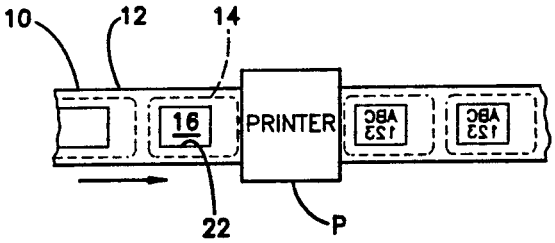
FIG. 6 is a fragmentary, diagrammatic top plan view illustrating the printing of indicia on a strip of labels.

FIG. 6 illustrates how the label system of the invention may be used to print the labels with variable indicia. A strip of the label system 10 is advanced through a printer P. The printer may be of any suitable type, such as impact or thermal transfer. The printer prints through the release backing openings 22 onto the rear surface of the label central portions 16. It is necessary to design or print the variable indicia in reverse so that the labels are legible from the front. Such reverse printing may be accomplished in known manners such as by mechanical adaptations to the printers or programmed instructions to computer controlled printers. It is to be understood that the variable indicia may also be imprinted manually, such as with a pen or marker. In either case, it is desirable to leave an unprinted zone about the perimeter of the label central portion to allow for mechanical tolerances of the printing equipment and to avoid disturbing the margins of the release backing around the opening or the contact adhesive. It has been found that a zone about 3/16 inch wide is suitable.

After printing or marking, the label is removed or peeled from the backing and adhered to a desired surface or article. The variable indicia will thus lie underneath the label protected from damage.

The label system is constructed of conventional materials well known in the art. The labels are advantageously made of flexible, plastic sheet material and the release backing of coated paper. The label system is manufactured in conventional manner with the release backing openings formed preferably by die cutting after the labels have been placed on the backing.

While the invention has been disclosed with respect to a specific preferred embodiment, it should be understood that modifications and variations may be made without departing from the scope of the invention and the following claims.

The embodiments of the invention in which an exclusive property or privilege is claimed are defined as follows:

1. A label system comprising:

a backing sheet having a centrally disposed opening;

a label having a front surface, a rear surface with a peripheral border portion and a translucent central portion, an adhesive on a rear surface of said peripheral border, and a rear surface of said central portion being free of adhesive, and label rear surface adheringly and releasably overlying said backing sheet, said translucent central portion of said label being substantially coextensive with said back sheet opening;

whereby indicia may be marked through said opening onto the rear surface of said central portion while said label is adhered to said backing sheet, and whereby said label may then be released from said backing sheet and adhered to an article.

2. The label system of claim 1 further comprising indicia marked on said translucent portion of said label rear surface while said label is adhered to said backing sheet and being legible from said label front surface.

3. The label system of claim 1 wherein said label border has an appearance contrasting with the appearance of said label central portion.

4. The label system of claim 1 wherein said adhesive comprises a layer of contact adhesive applied to said label substantially coextensively with said label peripheral border on said label rear surface.

5. The label system of claim 1 further comprising preprinted indicia on said label border portion being legible from said label front surface.

6. The label system of claim 1 wherein said backing sheet comprises an elongated web having a plurality of said openings disposed at intervals along said web, and further comprising a plurality of said labels, each of said labels disposed in correspondence with an opening in said web.

7. A label system comprising:

an endless web of release paper defining a plurality of spaced window openings;

a plurality of labels one of each positioned over each of said window openings, each of said labels including a central translucent portion and a border portion surrounding said central portion, said central portion of each said label being coextensive with the associated window opening, whereby said central portions can be printed on through said window openings while said labels remain positioned over said window openings; and an adhesive on said border portion of each of said labels, said adhesive temporarily adhering said labels to said web, said central label portions being free of adhesive, whereby said labels can be removed from said web and applied to an article with the printing entrapped between said label and the article.

* * * * *